US007882978B2

(12) United States Patent
Modi et al.

(10) Patent No.: US 7,882,978 B2
(45) Date of Patent: Feb. 8, 2011

(54) THREADED CHANNEL CLOSURE FOR TUBULAR HEAT EXCHANGER

(75) Inventors: Anil Kumar Modi, Maharashtra (IN); Veeravali Ramesh Nembilli, Maharashtra (IN); Venkatesh Murur, Maharaashtra (IN)

(73) Assignee: Larsen & Toubro Limited (IN)

( * ) Notice: Subject to any disclaimer, the term of this patent is extended or adjusted under 35 U.S.C. 154(b) by 220 days.

(21) Appl. No.: 12/300,078

(22) PCT Filed: May 3, 2007

(86) PCT No.: PCT/IN2007/000183

§ 371 (c)(1),
(2), (4) Date: Nov. 7, 2008

(87) PCT Pub. No.: WO2008/015691

PCT Pub. Date: Feb. 7, 2008

(65) Prior Publication Data

US 2009/0133862 A1 May 28, 2009

(51) Int. Cl.
*B65D 45/02* (2006.01)
*B65D 45/30* (2006.01)
*F28F 9/02* (2006.01)

(52) U.S. Cl. ..... 220/327; 215/276; 220/328; 165/158

(58) Field of Classification Search ..... 165/158, 165/173–176; 215/273, 276; 220/327, 328
See application file for complete search history.

(56) References Cited

U.S. PATENT DOCUMENTS

| | | | | | |
|---|---|---|---|---|---|
| 2,340,756 | A | * | 2/1944 | Jacocks et al. | 292/256.71 |
| 2,363,526 | A | * | 11/1944 | Hobbs | 165/160 |
| 2,956,704 | A | * | 10/1960 | Boni, Jr | 220/328 |
| 4,325,428 | A | * | 4/1982 | Schuurman | 165/72 |
| 4,630,673 | A | * | 12/1986 | Belleli | 165/158 |
| 4,750,554 | A | * | 6/1988 | Oeij et al. | 165/158 |
| 2009/0095453 | A1 | * | 4/2009 | Modi et al. | 165/158 |
| 2009/0120608 | A1 | * | 5/2009 | Modi et al. | 165/47 |

FOREIGN PATENT DOCUMENTS

| | | | |
|---|---|---|---|
| EP | 614064 | A2 * | 9/1994 |
| WO | 2007122631 | A2 | 11/2007 |
| WO | 2007122632 | A1 | 11/2007 |

* cited by examiner

*Primary Examiner*—Anthony Stashick
*Assistant Examiner*—Ned A Walker
(74) *Attorney, Agent, or Firm*—Brooks Kushman P.C.

(57) ABSTRACT

Threaded channel closure for tubular heat exchanger comprising channel header wherein the gasket is provided at the shoulder of the channel, tongue of the diaphragm is provided to apply pressure on the gasket to achieve the sealed joint, outer compression ring provided at back side of the diaphragm and being loaded by push bolts, provided at the periphery of threaded lock ring, outer compression ring being supported by channel cover, which is kept in position by threaded lock ring, characterized in that, the channel header being provided with plurality of radial holes on its periphery, approximately at the centerline of the width of the outer compression ring in its assembled condition; the outer compression ring being provided with plurality of radial through holes matching the set of holes in number as well as angular position.

5 Claims, 4 Drawing Sheets

THREADED CHANNEL CLOSURE FOR TUBULAR HEAT EXCHANGER

TECHNICAL FIELD

The present invention relates to threaded channel closure, high pressure shell and tube heat exchangers having removable tube bundles such as U-tubes and floating heads. Such heat exchangers are widely used in critical services in a number of process industries such as Hydrocracking units, Hydrodewaxing units, Hydrofining units etc.

BACKGROUND ART

The prior art is described below with help of following figures.

FIG. 1 shows the sectional view of the channel header assembly of typical H-H type heat exchanger as described bellow.

FIG. 2 shows the sectional view of the channel header assembly of typical H-L type heat exchanger as described bellow.

Threaded channel closure type heat exchangers are generally classified based on the operating pressures on the shell and tube sides.

The heat exchangers, which have high pressure on both, shell side as well as tube side, are classified as H-H type heat exchangers.

The heat exchangers, which have higher pressure on channel side and lower pressure on shell side, are classified as H-L type heat exchangers.

Thus in H-H type heat exchangers, tubesheets are subjected to lesser differential pressure and consequently would typically have internal tubesheet with apparatus for sealing the tubesheet against the shoulder of the channel.

In H-L type heat exchangers, the tubesheet can typically get exposed to full pressure of either side independently. H-L type would typically have tubesheet and channel of integral construction, either single piece or welded together. The shell of the H-L type could be independently bolted or welded to the tubesheet.

Tubesheets are provided with plurality of holes in which the tubes 5 are fixed. The channel (1) is provided with nozzles (6) for the tube side fluid to enter and exit the heat exchanger. The heat exchangers are preferably provided with two or more tube passes and accordingly, some of the tubes are in the first tube pass through which the tube side fluid enters the tube bundle from the channel side of the nozzle, while some tubes are in the final tube pass through which the tube side fluid exits from the tube bundle to the channel side exit nozzle.

Both H-H and H-L type heat exchangers have channel headers (1) provided with a threaded closure consisting of threaded lock ring (2) and channel cover (3). Threaded lock ring is screwed in the threads provided in the channel header body.

The closure is sealed by means of a gasketed joint. The gasket (7) is located in a groove made in shoulder of the channel ahead of the threads. The gasket is compressed through the peripheral portion i.e. the tongue of the diaphragm (8). The diaphragm (8) is backed by a compression ring (9) at the periphery; and at the center, it is backed by channel cover. The channel cover is held in position by the threaded lock ring (2). The push bolts/rods (10) assembled at the periphery of the threaded lock ring pressurize the compression ring (9), which in turn presses tongue of the diaphragm to seal the gasket. The end thrust due to internal pressure on diaphragm is essentially transmitted to and resisted by the channel threads via channel cover, outer compression ring and threaded lock ring. The push bolts/rods (10) on the threaded lock ring (2) provide incremental loading to the gasket through the tongue of the diaphragm for achieving the leak-tight joint.

The assembly procedure of the prior art heat exchanger is as given below.

The diaphragm (8) and the outer compression ring (9) are placed in position. The diaphragm (8) and compression ring (9) are held in position by means of internal grub screws (11). These grub screws are screwed in the radial threaded holes provided in the outer compression ring (9). These grub screws are assembled from inner side of the outer compression ring and project beyond the outside diameter of outer compression ring to get engaged in the dimples (51) provided in the channel barrel. These grub screws remain under flush with respect to the inside diameter of outer compression ring to avoid interfering with the channel cover. After this, the channel cover (3) and threaded lock ring can be assembled.

It should be noted that the heat exchangers under consideration are very heavy and the size and weight of the components like channel cover and the threaded lock ring can be in the range of 600 mm to 2000 mm in diameter and weights in the range of 200 kg to 10000 kg. Naturally, such parts require liberal clearances between their mating parts (typically of the order of 0.5 mm to 2 mm radially) to facilitate the assembly. The arrangement of the closure is such that the major portion of the cover gets located in the inside diameter of the threaded lock ring whereas a small portion of the channel cover, whose diameter is bigger than the inside diameter of the threaded lock ring remains ahead of the threaded ring and enters into the outer compression ring. Therefore, the threaded lock ring can be assembled only when the channel cover is in position. At the same time, the channel cover cannot remain in position without being engaged with the threaded lock ring. Hence, the existing art is to handle both the threaded lock ring and the channel cover together for assembly into the channel header. Hence, it is necessary to handle the threaded lock ring and the channel cover together. These components are mounted on a special cantilever type fixture and are required to be skillfully balanced using counterweights to make them vertical and aligned with the centerline of the channel. Further, during assembly, while the cover remains stationary, the threaded lock ring is required to be rotated. The existing methodology of balancing the assembly, alignment of the threaded lock ring with the threads on the channel body is very difficult, cumbersome and time consuming process and if not done properly can severely damage the equipment and/or its components.

The grub screws (11), which are screwed from inside of the outer compression ring (9) can hamper free movement of the compression ring (9) and the diaphragm (8). After equipment has been exposed to operating condition, invariably these grub screws (11) get jammed and become extremely difficult to unscrew, more so because these screws are under flush with outer compression ring and at times get broken leading to major repair of the equipment.

There is definitive tendency for the push bolts to get jammed particularly when the equipment has been in service for some period of time due to deposition of extraneous matter, scaling, rusting and/or galling in the threaded portion. When the torque is applied for loosening of such jammed bolts, it is very likely that the heads of the bolts are sheared off. The removal and replacement of these sheared bolts is very difficult and cumbersome and not always possible at the site of installation.

As mentioned above, generous clearances are provided between the mating roots and crests of the male threads on the threaded lock ring (2) and female threads on the channel barrel to facilitate smooth assembly. Ideally, it is required that, this clearance should remain distributed uniformly and equally around the circumference so that the load transfer takes place along the contact at side of the flanks of the threads along the pitch line of the threads. However, due to the self weight, there is a natural tendency for the threaded lock ring (2) to settle down towards the bottom portion. This could induce differential force around the circumference leading to eccentric forces on the threads, leading to very high contact stresses in the bottom side of the thread flanks compared to that on the top side. This could lead to scoring/scrapping of the metal during unscrewing, especially after the heat exchanger has been exposed to operating conditions for some time, leading to jamming of the threads and can cause severe damage to the equipment.

DISCLOSURE OF INVENTION

Considering the above drawbacks of the prior art the present invention endeavors to eliminate them. The objective of the present invention is to render assembly easy by facilitating independent handling of the channel cover and threaded lock ring.

Another objective of the present invention is to avoid or eliminate the jamming of the push bolds to stop their breakage.

Yet another objective of the present invention is to eliminate the problems that are caused by the eccentric fitting of the threaded lock ring (2).

In the present invention the grub screws (11) and the dimples (51) used in the prior art are eliminated. Instead, the threaded pins which are inserted from out side in the peripheral holes drilled radially on the channel body, these pins being provided with nuts, engaged in the stopper cleats fitted on the channel cover. Radial, through holes are provided on the periphery of the outer compression ring to match in numbers as well as position with the radial holes in the channel body, while blind radial holes are provided on the channel cover which match with these holes in number and position. With this arrangement, the assembly can be done as described below.

The gasket is assembled in position. The diaphragm and compression ring are then placed in position and the radial holes on the compression ring are matched with the radial holes in the channel body. The threaded pins are then screwed in to the extent that, they engage with the radial holes in the compression ring, thus locating the compression ring in position. The channel cover (independent of the threaded lock ring) is then inserted to its assembly position, the radial blind holes on the channel cover are matched with the pins and the pins are further screwed in to engage these blind holes. The pins then are sequentially screwed in and out to position the channel cover concentric with the threads of the channel header (1), which houses the closure assembly. Then the threaded lock ring can be assembled in position separately and the push bolts are tightened thereafter. The threaded pins are withdrawn after the assembly is completed.

Plurality of holes is provided in the threaded lock ring and channel cover so as to supply lubricating oil to the threading of every push bolt and the threaded joint between the channel barrel and the threaded lock ring. This ensures ease of assembly and disassembly of these components with out any damage.

The outer diameter of the threaded lock ring is located concentric by providing a guide ring, fixed to the channel header at its outer end, the inner diameter of the guide ring having close tolerance giving locating fit with the mating outer diameter of the threaded lock ring.

At the same time, the threaded lock ring is also located concentric at its inner end by providing the close tolerance outer diameter for a short length on the channel cover to achieve location fit with the mating inner diameter of the threaded lock ring; followed by a conical or taper diameter for some length followed by the diameter with normal clearance between the outer diameter of the channel cover and mating inner diameter of threaded lock ring. Due to this, the assembly of the threaded lock ring remains easy, at the same time the threaded lock ring gets located in its correct concentric position in final assembly. This ensures uniform loading of the threads at their pitch line in working condition and eliminates the problems caused by eccentric fitting as in the case of the prior art heat exchangers.

STATEMENT OF THE INVENTION

Threaded channel closure for tubular heat exchanger comprising channel header (1) wherein the gasket (7) is provided at the shoulder of the channel, tongue of the diaphragm (8) is provided to apply pressure on the gasket to achieve the sealed joint, outer compression ring (9) provided at back side of the diaphragm 8 and being loaded by push bolts (1), provided at the periphery of threaded lock ring (2), outer compression ring (9) being supported by channel cover (3), which is kept in position by threaded lock ring (2), characterized in that, the channel header (1) being provided with plurality of radial holes (108) on its periphery, approximately at the centerline of the width of the outer compression ring (9) in its assembled condition. The outer compression ring (9) being provided with plurality of radial through holes (104) matching the set of holes (108) in number as well as angular position; the channel cover (3) being provided with set of blind holes (105) matching with the sets of holes (108) in channel header (1) and hence also with set of holes (104) in the outer compression ring (9). Plurality of threaded holding pins (14) being provided to engage with the sets of holes (104), (105) and (108) together with adjusting nuts (13) provided on threaded portion of the threaded holding pins (14). Plurality of cleats (12) in the form of a pair of inverted "L" shaped pieces or other shapes or configurations being fixed on the channel header (1) adjacent to the holes (108), and being so arranged that, threaded holding pin (14) can easily pass through the same, while the outward radial movement of the nut (13), which is provided on the pin (14), is restricted by the cleat (12).

Plurality of holes (16) and (18) being provided in the threaded lock ring (3) so as to feed the lubricating fluid to each of the threaded bolts (10) and the threaded joint between the threaded lock ring and the channel header (1); plurality of holes (17) being provided to feed lubricating fluid to the inner push bolts.

Outer diameter of the channel cover (3) mating with the threaded lock ring (2) being provided with close tolerance to achieve location fit for a small length (approximately 10 mm to 100 mm) at the portion shown at (101), for a small length after that, followed by a conical or taper diameter portion (102) and rest of the diameter of the channel cover further to that, being provided with normal (liberal) clearance.

Guide ring (15) being fitted with threaded fasteners (107) at the end of the channel header, the inner diameter of the guide ring (15) being provided with close tolerance to achieve location fit with the mating outer diameter of the threaded lock ring (2); thus the threaded lock ring (2) being supported accurately concentric at both the ends viz. on diameter shown at (101) at the inner end and the diameter shown at (106) at the outer end.

Threaded channel closure for tubular heat exchanger being assembled with method which comprises, fitting of the gasket (7), diaphragm (8) and compression ring (9) in position; matching the set of holes (104) on the compression ring (9) with set of holes (108) in the channel header (1); the threaded holding pins (14) being inserted and screwed in with the help of nut (13) in cooperation with the cleats (12), to the extent that, they engage the set of holes (104) in the compression ring (9) after passing through the set of holes (108) in the channel header (1); the diaphragm (8) and the compression ring (9) thus being held in position; thereafter the channel cover (3) being brought in position independent of the threaded lock ring (2) and set of holes (105) in it being matched with sets of holes (104) and (108) mentioned above; the aforesaid threaded holding pins (14) being then further screwed in to engage the blind holes (105) provided in the channel cover (3); the channel cover (3) then being set accurately concentric with the channel barrel by differential screwing in or out of the threaded holding pins (14); the guide ring (15) then being fitted in position and fastened to the end of channel header (1), by means of threaded fasteners (107); once the channel cover (3) is positioned concentric, the threaded lock ring (2) being independently brought and engaged and screwed in the threads of the channel barrel (1); the mating diameters of the threaded lock ring (2) with that of channel cover (3) (outer diameter) and the guide ring (15) (inner diameter) shown at (101) and (106) respectively, guiding the threaded lock ring (3) accurately concentric with channel barrel due to the location fit achieved by close tolerances on outer diameter of channel cover (3) at diameter shown at (101) and the inner diameter of the guide ring (15) shown at (106) respectively.

BRIEF DESCRIPTION OF DRAWINGS

The present invention "Threaded channel closure for tubular heat exchangers", is now described in detail with the help of following figures.

MODE(S) OF CARRYING OUT THE INVENTION

Figure 1:
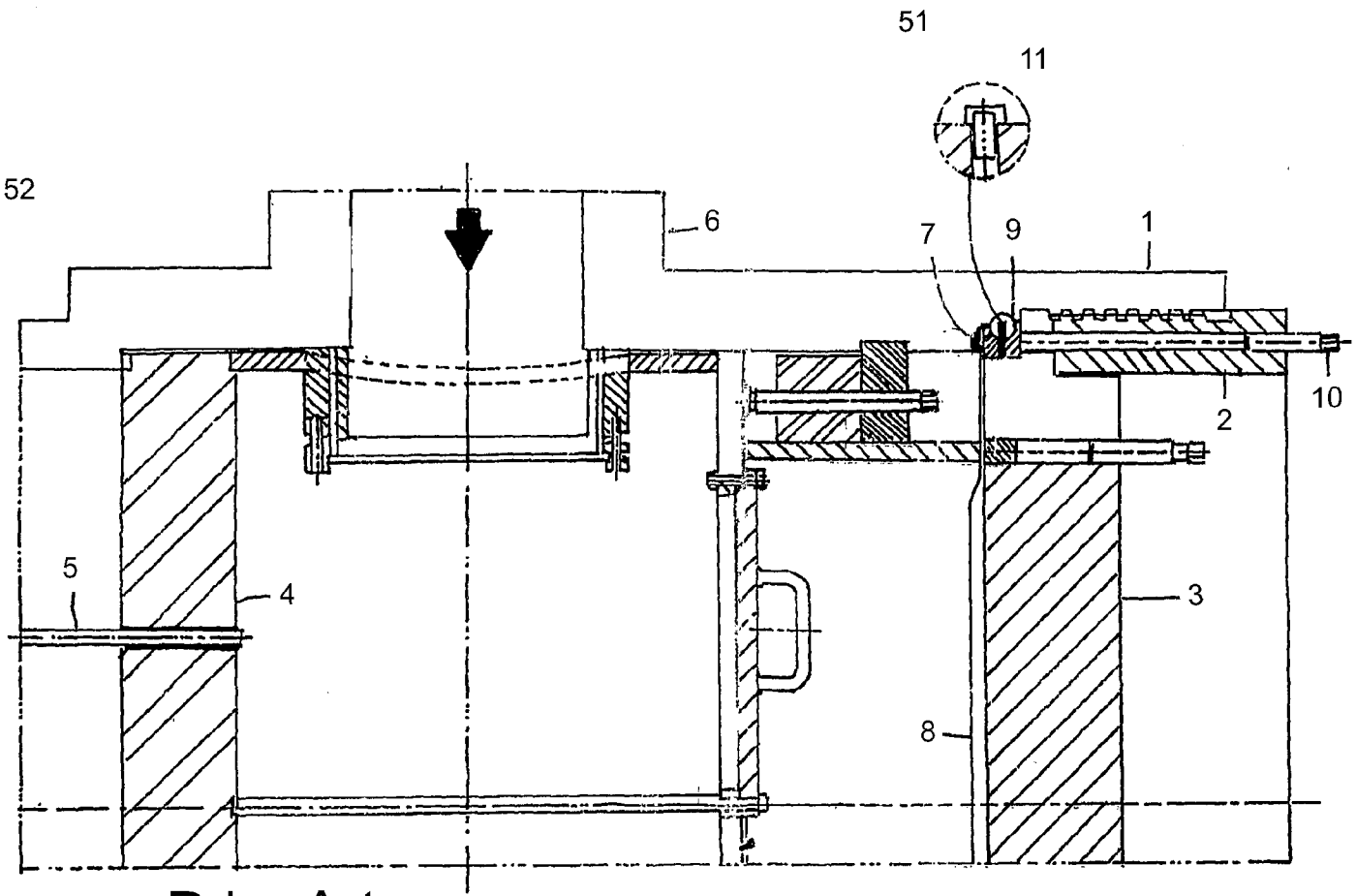
Prior Art Fig. 1
Figure 2:
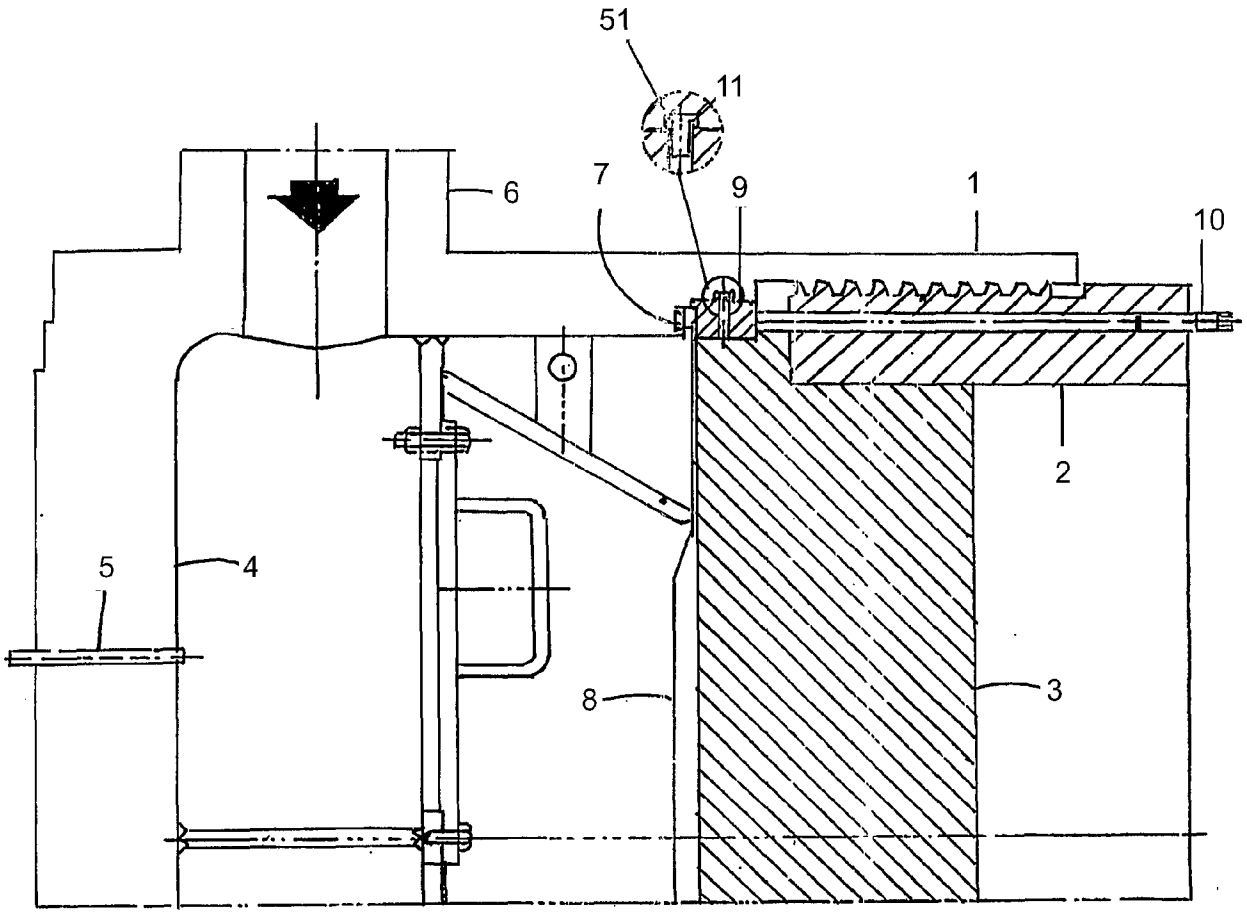
Prior Art Fig. 2
Figure 3:
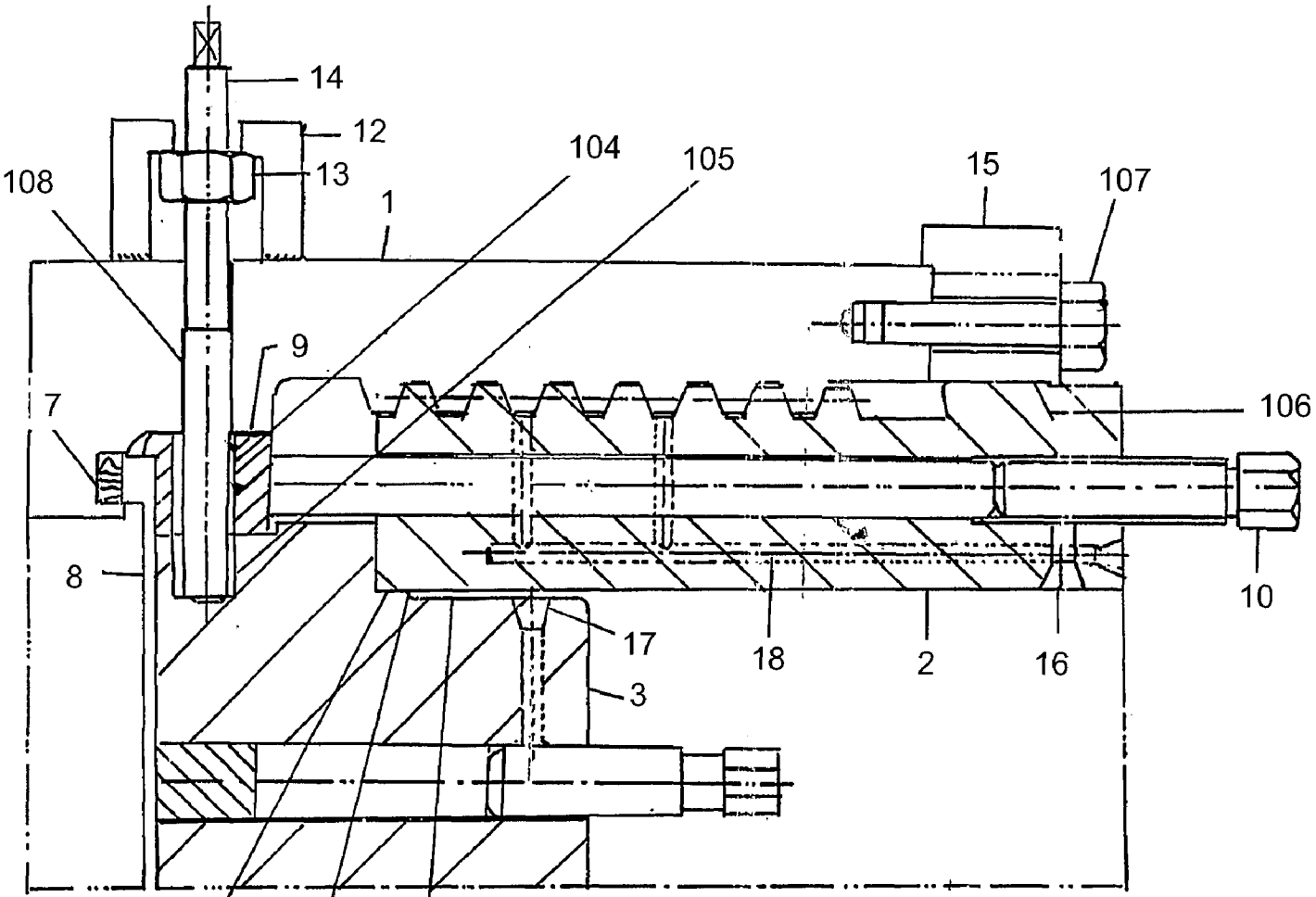
FIG. 3 shows the sectional view of the present invention.

The foregoing objects of the invention are accomplished and the problems and shortcomings associated with prior art techniques and approaches are overcome by the present invention as described bellow in the preferred embodiment.

This invention is illustrated in the accompanying drawings, through out which like reference letters indicate corresponding parts in the various figures.

The details of this invention as described below are applicable to both H-H as well as H-L type heat exchangers as they are defined above.

The invention "Threaded channel closure for tubular heat exchangers" comprises, channel header (1) wherein the gasket (7) is provided at the shoulder of the channel, tongue of the diaphragm (8) is provided to apply pressure on the gasket (7) to achieve the sealed joint. Outer compression ring (9) is provided at the back side of the diaphragm (8) and is loaded by tightening of the push bolts (10) provided in the threaded holes provided at the periphery of the threaded lock ring (2). This load through the diaphragm (8) is transferred to gasket (7) to achieve the leak proof joint. Outer compression ring (9) is supported by channel cover (3), which is kept in position by the threaded lock ring (2).

Figure 4A:
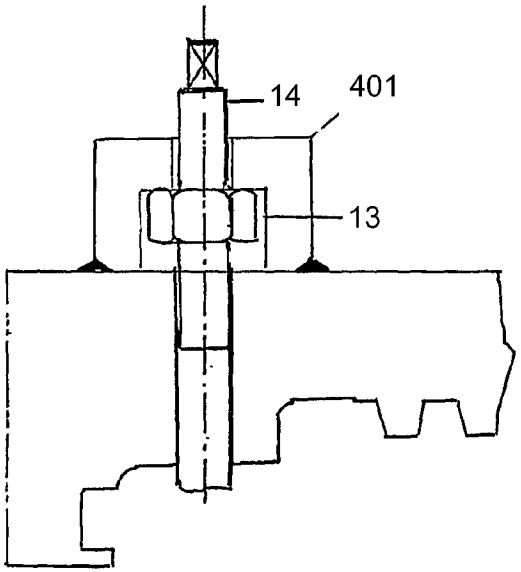
FIGS. 4*a*, 4*b*, 4*c* show sectional view of the alternative arrangements for cleats (12) and nuts (13) as shown in FIG. 3.
Figure 4B:
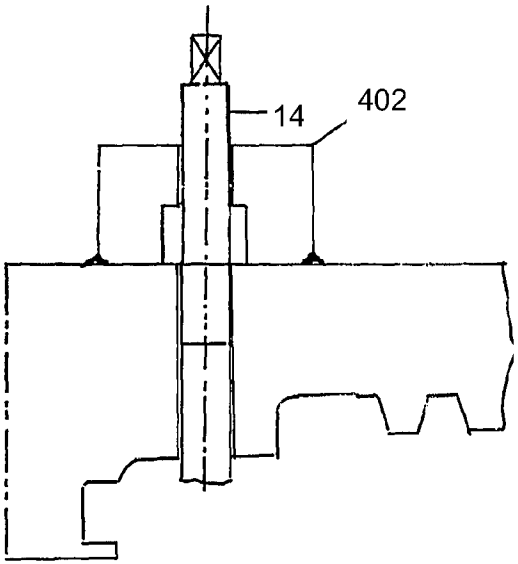
Figure 4C:
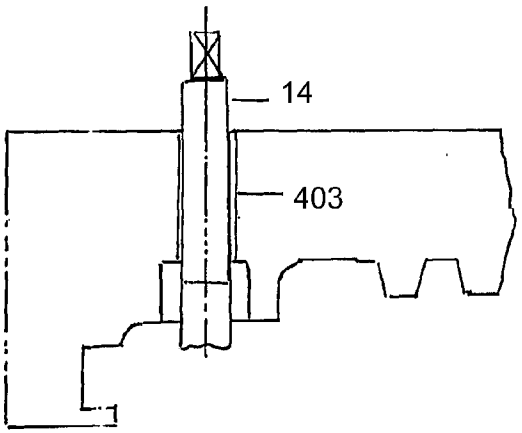

The channel header (1) is provided with plurality of radial holes (108) on its periphery, approximately at the centerline of the width of the outer compression ring (9) in its assembled position. The outer compression ring (9) is provided with plurality of radial through holes (104) matching the set of holes (108) in number as well as angular and axial positions. Channel cover (3) is provided with a set of blind holes (105) matching the sets of holes (108) in channel header and hence also the set of holes (104) in the outer compression ring (9). Plurality of threaded holding pins (14) are provided, to engage with the sets of holes described above, together with adjusting nuts (13) provided on the threaded portion of the pins (14). Cleats in the form of a pair of inverted "L" shaped pieces or of other shape or configuration are fixed on the channel header adjacent to the holes (108), are so arranged that the threaded holding pin (14) can easily pass through the same, while the outward radial movement of the nut (13), provided on the pin (14), is restricted by the cleat. In an alternative arrangement, these cleats can be replaced by a hollow boss, (Ref. FIG. 4*a*) provided with a recess to accommodate and restrict the radial movement of the nut (13) but permitting the entry of the threaded lock ring (14). In yet another embodiment as shown in FIG. 4*b*, a boss (402) can be provided having threading to match the threading of the threaded holding pins (14). In yet another embodiment, as shown in FIG. 4*c* the threaded holes (403) can be provided in the channel header it self instead of providing the cleats and nuts as mentioned above.

Plurality of holes (16) and (18) are provided in the threaded lock ring (2) so as to feed lubricating fluid to each of the threaded bolts (10) and threaded joint between the threaded lock ring (2) and the channel header (1) respectively. Plurality of holes (17) is provided to feed the lubricating fluid to the inner push bolts.

The outer diameter of the channel cover (3) mating with the inner diameter of the threaded lock ring (2) is provided with close tolerance to achieve location fit for a small length (approximately 25 mm to 250 mm) at the portion shown at (101), for a small length after that, followed by a conical or tapered diameter portion (102). Rest of the outer diameter of the channel cover (3) further to that is with a normal i.e. liberal clearance, so as to provide easy movement of the threaded lock ring (2) during assembly, until it reaches its final position. Due to this, front end of the threaded lock ring (2) is held concentric with channel threads in its final assembled position. Guide ring (15) is fitted preferably with threaded fasteners (107) at the outer end of the channel header (1). The guide ring (15) is provided with inner diameter at (106) having close tolerance, to achieve location fit with the mating outer diameter of the threaded lock ring (2) to ensure concentricity of the same at the outer end. Thus threaded lock ring (2) being supported concentric at both, the inner end as well as the outer end gets located concentric to the channel threads, uniformly loading the threads at their side flanks.

The method of assembly of the heat exchanger is much simplified with these improvements and can be done as given below.

First the gasket (7), diaphragm (8), and the compression ring (9) are positioned at the required location as shown in the FIG. 4. Set of holes (104) on compression ring (9), are matched with the set of holes 108 in the channel header (1). The threaded holding pins (14) are then inserted and screwed in with help of the nut (13), to the extent that, they engage the set of holes (104) in the compression ring (9); after passing though the set of holes (108) in the channel body (1). The compression ring (9), diaphragm (8) and the gasket (7) are thus held in position. Thereafter the channel cover (3) is brought in position independent of the threaded lock ring (2) and the set of holes (105) in it are matched with the sets of holes (104) and (108) mentioned above. The aforesaid threaded holding pins (14) are further screwed in, to engage the blind holes (105) provided in the channel cover (3). The channel cover (3) is then set accurately concentric with the channel threads by differential screwing in or out of the threaded holding pins (14). The guide ring (15) is then fitted in position and fastened to the end of the channel header (1) by means of threaded fasteners (107). Once the channel cover (3) is positioned concentric, the threaded lock ring (2) is independently brought and engaged and screwed in the threads of the channel header (1). While the threaded lock ring (2) is reaching its final assembly position, its mating diameters at (101) and (106) get engaged with that of channel cover (3) and guide ring (15) respectively and locate the threaded lock ring (2) accurately concentric with the channel threads.

The foregoing objects of the invention are accomplished and the problems and shortcomings associated with prior art techniques and approaches are overcome by the present invention described in the present embodiment.

Detailed descriptions of the preferred embodiment are provided herein; however, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or matter.

The embodiments of the invention as described above and the methods disclosed herein will suggest further modification and alterations to those skilled in the art. Such further modifications and alterations may be made without departing from the spirit and scope of the invention; which is defined by the scope of the following claims.

We claim:

1. A threaded channel closure for a tubular heat exchanger comprising:

a channel header wherein a gasket is provided at a shoulder of a channel, a tongue of a diaphragm is provided to apply pressure on the gasket to achieve a sealed joint, an outer compression ring is provided at a back side of the diaphragm and being loaded by push bolts provided at a periphery of a threaded lock ring, the outer compression ring being supported by a channel cover, which is kept in position by the threaded lock ring, wherein:

the channel header is provided with a first plurality of radial holes on a periphery of the channel header, approximately at a centerline of a width of the outer compression ring in an assembled condition;

the outer compression ring being provided with a second plurality of radial holes matching the first plurality of radial holes in number as well as angular position;

the channel cover being provided with a set of blind holes matching with the first plurality of radial holes and hence also with the second plurality of radial holes;

a plurality of threaded holding pins being provided to engage with the first and second plurality of radial holes and the blind holes together with adjusting nuts provided on a threaded portion of the threaded holding pins;

a plurality of cleats being fixed on the channel header adjacent to the first plurality of radial holes and being arranged such that the threaded holding pins can easily pass therethrough, while a radial movement of the nuts is restricted by the cleats;

a first plurality of feed holes being provided in the threaded lock ring so as to feed lubricating fluid to a threaded push bolt and to a threaded joint between the threaded lock ring and the channel header;

a second plurality of feed holes being provided to feed lubricating fluid to an inner push bolt;

an outer diameter of the channel cover mating with the threaded lock ring being provided with close tolerance to achieve a location fit for a first small length of approximately 10 mm to 100 mm and for a second small length, followed by a tapered diameter portion and a remainder of the diameter of the channel cover being provided with liberal clearance; and a guide ring being fitted with threaded fasteners at an end of the channel header, an inner diameter of the guide ring being provided with close tolerance to achieve a mating fit to the outer diameter of the threaded lock ring, thus the threaded lock ring is supported accurately concentric at an inner end and an outer end.

2. The threaded channel closure of claim 1, being assembled with a method comprising the steps of:

fitting of the gasket and the diaphragm and the compression ring in position;

matching the second plurality of radial holes with the first plurality of radial holes, the threaded holding pins being inserted and screwed in with the help of the nuts in cooperation with the cleats, to the extent that they engage the second plurality of holes after passing through the first plurality of holes, the diaphragm and the compression ring thus being held in position;

bringing the channel cover in position independent of the threaded lock ring and the blind holes and being matched with the first and second plurality of radial holes;

screwing the threaded holding pins further to engage the blind holes, the channel cover then being set concentric with the channel threads by differential screwing in or out of the threaded holding pins;

fitting the guide ring in position and using the threaded fasteners to fasten the guide ring to the channel header; and once the channel cover is positioned concentric, bringing the threaded lock ring independently and engaged and screwed in the channel header, mating diameters of the threaded lock ring with that of the outer diameter of the channel cover and the inner diameter of the guide ring, guiding the threaded lock ring accurately concentric with channel cover due to the mating fit achieved by close tolerances on outer diameter of channel cover and the inner diameter of the guide ring.

3. The threaded channel closure of claim 1, wherein hollow bosses are provided so as to accommodate and restrict the radial movement of the nuts, and permitting entry of the threaded holding pins as an alternative arrangement for the cleats.

4. The threaded channel closure of claim 1, wherein bosses are provided having threaded holes to match the threading of the threaded holding pins as an alternative arrangement for the cleats and the nuts.

5. The threaded channel closure of claim 1, wherein threaded holes are provided in the channel cover as an alternative arrangement for the cleats and the nuts.

* * * * *